US008739568B2

(12) United States Patent
Allard et al.

(10) Patent No.: US 8,739,568 B2
(45) Date of Patent: Jun. 3, 2014

(54) APPLIANCE FEATURE MODULE ENABLED BY ENERGY OR MATERIALS SOURCED FROM THE HOST APPLIANCE

(75) Inventors: Paul B. Allard, Stevensville, MI (US); Robert Ryan Bradley, Granger, IN (US); James W. Kendall, Mount Prospect, IL (US); Steven J. Kuehl, Stevensville, MI (US); Alan S. Lucas, Evansville, IN (US); Andrew M. Tenbarge, Saint Joseph, MI (US); John J. Vonderhaar, Saint Joseph, MI (US); Guolian Wu, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1148 days.

(21) Appl. No.: 12/539,676

(22) Filed: Aug. 12, 2009

(65) Prior Publication Data

US 2009/0293511 A1 Dec. 3, 2009

Related U.S. Application Data

(63) Continuation-in-part of application No. 12/402,559, filed on Mar. 12, 2009, now Pat. No. 8,176,746.

(60) Provisional application No. 61/035,775, filed on Mar. 12, 2008.

(51) Int. Cl.
*F25D 19/02* (2006.01)

(52) U.S. Cl.
CPC ..... *F25D 19/02* (2013.01)
USPC ..... 62/448

(58) Field of Classification Search
CPC ..... F25D 19/02; F25D 2317/062
USPC ..... 62/3.2, 77, 100, 115, 126, 169, 268, 62/293, 377, 389, 391, 397, 440, 441, 449, 62/259.1, 227, 447, 267, 448; 312/404, 312/405.1; 222/95
See application file for complete search history.

(56) References Cited

U.S. PATENT DOCUMENTS

| | | | | |
|---|---|---|---|---|
| 3,178,061 | A * | 4/1965 | Giacalone et al. | 222/129 |
| 4,027,499 | A | 6/1977 | Barto et al. | |
| 4,830,223 | A | 5/1989 | Priest | |
| 5,083,442 | A | 1/1992 | Vlock | |
| 5,100,213 | A | 3/1992 | Vandarakis et al. | |
| 5,112,241 | A | 5/1992 | Chesnut et al. | |
| 5,211,314 | A * | 5/1993 | Burrows | 222/481.5 |
| 5,445,452 | A | 8/1995 | Kauffman et al. | |
| 5,558,256 | A | 9/1996 | Miller et al. | |

(Continued)

FOREIGN PATENT DOCUMENTS

CA 2370912 A1 8/2003

*Primary Examiner* — Mohammad M Ali
*Assistant Examiner* — Emmanuel Duke

(57) ABSTRACT

A modular utility supply unit that includes a utility supply module housing having removable engageability to a surface of an appliance. Also included is at least one refillable reservoir capable of storing a plurality of utilities and receiving at least one utility from the appliance when the utility supply unit is operably engaged to the appliance. Further included is an interface capable of engaging a plurality of feature modules, where the interface includes a recognition device that prompts the utility supply unit to provide the engaged feature module with at least one of the storage utilities within the utility supply from at least one of the refillable reservoirs.

20 Claims, 9 Drawing Sheets

(56) References Cited

U.S. PATENT DOCUMENTS

| | | | | |
|---|---|---|---|---|
| 5,765,390 | A | 6/1998 | Johnson et al. | |
| 5,791,517 | A * | 8/1998 | Avital | 222/1 |
| 5,816,058 | A | 10/1998 | Lee et al. | |
| 5,894,738 | A | 4/1999 | Choi | |
| 6,048,215 | A * | 4/2000 | Tateishi | 439/102 |
| 6,085,542 | A | 7/2000 | Johnson et al. | |
| 6,159,041 | A | 12/2000 | Davis et al. | |
| 6,231,146 | B1 | 5/2001 | Dang | |
| 6,351,966 | B1 | 3/2002 | Hochberg | |
| 6,574,984 | B1 | 6/2003 | McCrea et al. | |
| 6,675,593 | B1 | 1/2004 | Suydam et al. | |
| 6,782,710 | B2 | 8/2004 | Eveland et al. | |
| 6,868,692 | B2 | 3/2005 | Choi | |
| 6,983,615 | B2 | 1/2006 | Winders et al. | |
| 7,287,397 | B2 | 10/2007 | Coulter et al. | |
| 7,309,116 | B2 | 12/2007 | Garrett et al. | |
| 2004/0261443 | A1 * | 12/2004 | Crisp et al. | 62/390 |
| 2005/0076667 | A1 | 4/2005 | Deem, Jr. | |
| 2005/0178273 | A1 | 8/2005 | Meuleners et al. | |
| 2006/0250063 | A1 * | 11/2006 | Czach et al. | 312/405.1 |
| 2007/0157655 | A1 * | 7/2007 | Eveland et al. | 62/377 |
| 2007/0159041 | A1 | 7/2007 | Lucas et al. | |

* cited by examiner

APPLIANCE FEATURE MODULE ENABLED BY ENERGY OR MATERIALS SOURCED FROM THE HOST APPLIANCE

CROSS-REFERENCE TO RELATED APPLICATIONS

This application is a continuation-in-part of U.S. patent application Ser. No. 12/402,559, entitled "VACUUM FOOD PRESERVATION SYSTEM," filed on Mar. 12, 2009, the entire disclosure of which is hereby incorporated by reference. U.S. patent application Ser. No. 12/402,559 claims priority under 35 U.S.C. §119(e) to, and the benefit of, U.S. Provisional Patent Application No. 61/035,775, entitled "REFRIGERATOR WITH SPACE MANAGEMENT MODULES," filed on Mar. 12, 2008, the entire disclosure of which is hereby incorporated by reference.

BACKGROUND OF THE INVENTION

Refrigerators are available in many styles, but the most common styles include both a refrigerator compartment and a freezer compartment, which may be side-by-side or one on top of the other. Often, refrigerator features such as ice making, ice crushing, water dispensing, precise temperature and/or humidity control, vacuum packaging, thawing, and fast chilling are available. All of these features require some type of utility, such as water, chilled air or mechanical power to provide the benefit. These utilities must be hardwired into the appliance, typically at a specific location which limits flexibility to customize the product to specific owner desired locations, and does not give them the ability to add or delete the feature. Additionally, if utilities are to be conveyed to a specific location, the conduits for water, air, and electrical power must be designed to deliver utility at some level partially governed by the transfer capacity of the conduit, for example, water flow or electrical wattage.

SUMMARY OF THE INVENTION

One aspect of the present invention is to provide an appliance modular system that includes an appliance and at least one feature module that is removably engageable with the appliance. The appliance has a rear wall section, a first side wall section, a second side wall section, a top, a bottom, at least one appliance door, and an interior. A refrigerator section is within the appliance interior. The refrigerator section has the same or a smaller volume than the interior of the appliance. The appliance door has an exterior surface, an interior surface having a door liner, and closes to create an insulated area. The appliance module system further includes a utility supply module. The utility supply module includes a common interface that provides removable engageability to at least one, more typically a plurality of feature module. The interface typically includes a module recognition device for identifying the feature module. The utility supply module also includes at least one refillable reservoir, but more typically a plurality of refillable reservoirs, capable of storing a plurality of utilities, where at least one, but more typically more than one, of the plurality of utilities is supplied to the feature module when the utility supply module is engaged to the feature module.

Another aspect of the present invention is to provide a modular utility supply unit. The unit includes a utility supply module housing having removable engageability to a surface of an appliance. Also included is at least one refillable reservoir capable of storing a plurality of utilities and receiving at least one utility, but typically a plurality of utilities, from the appliance when the utility supply unit is operably engaged to the appliance. Further included is an interface capable of engaging a plurality of feature modules, where the interface includes a recognition device that prompts or otherwise directs the utility supply unit to provide the engaged feature module with at least one of the storage utilities within the utility supply from at least one of the refillable reservoirs.

Yet another aspect of the present invention includes a method for supplying utility to various feature modules. The method includes providing an appliance having a rear wall section, a first side wall section, a second side wall section, a top, a bottom, at least one appliance door, an interior, and a refrigerator section within the appliance interior having the same or a smaller volume than the interior of the appliance. The appliance door has an exterior surface and an interior surface and closes to create an insulated area. A utility supply module may be removably engaged with the appliance. Typically, the utility supply module has a common interface that provides engageability to a plurality of feature modules. The interface typically has a modular recognition device for identifying the class of feature module of the utility supply module is engaged with. The utility supply module typically has at least one refillable reservoir, but may include a plurality of refillable reservoirs, capable of storing a plurality of utilities. At least one of the plurality of utilities is supplied to the engaged feature module from the appliance. The method typically further includes the steps of engaging the utility supply module with the appliance; and replenishing (at least partially) each refillable reservoir with the utility at a first rate, where the utility supply module has access to a plurality of utilities. The method also includes the step of engaging the feature module with the utility supply module, where the feature module engaging step includes operably connecting the feature module to the utility supply module through the common interface, and where the module recognition device is capable of recognizing which of the plurality of storage utilities is appropriate to supply the engaged feature module based upon input from the module recognition device. The method also typically includes the step of supplying the engaged feature module with at least one of the storage utilities at a second rate that is the same rate or a faster rate (more typically it is a faster rate) than the first rate. Typically, the module recognition device instructs the appliance which utility or utilities to supply to the feature module.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
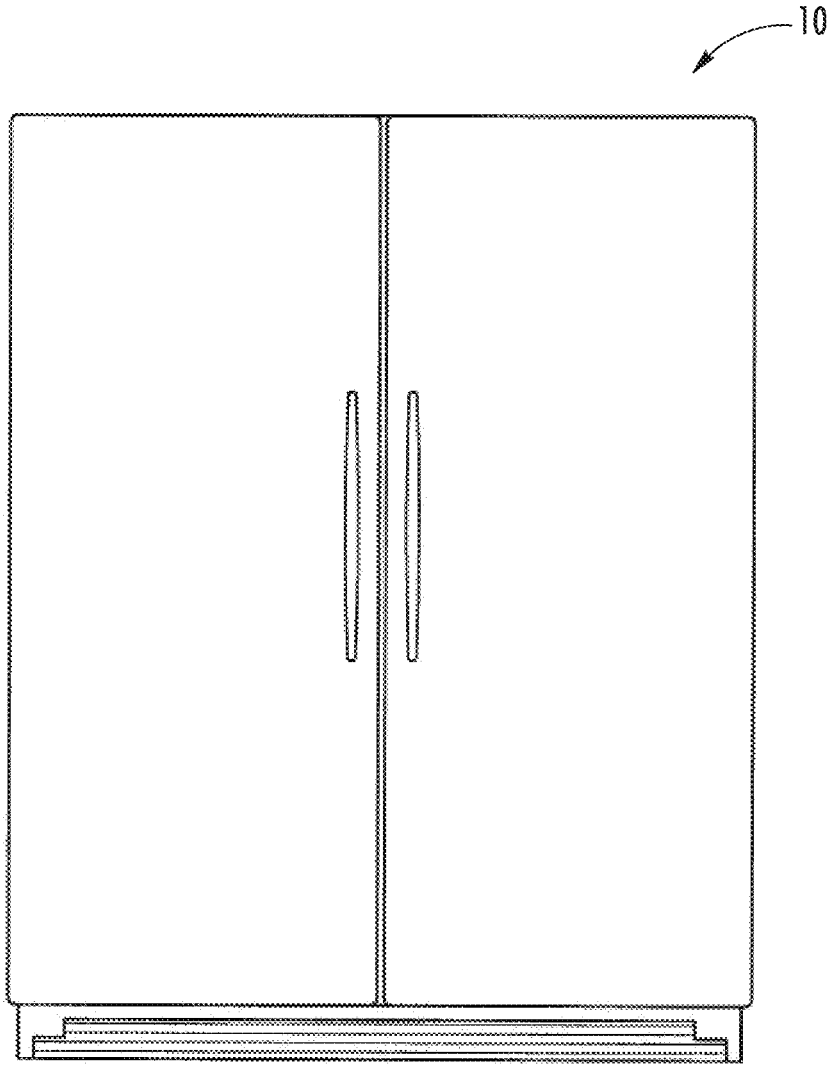
FIG. 1 is an elevational front view of an appliance modular system.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
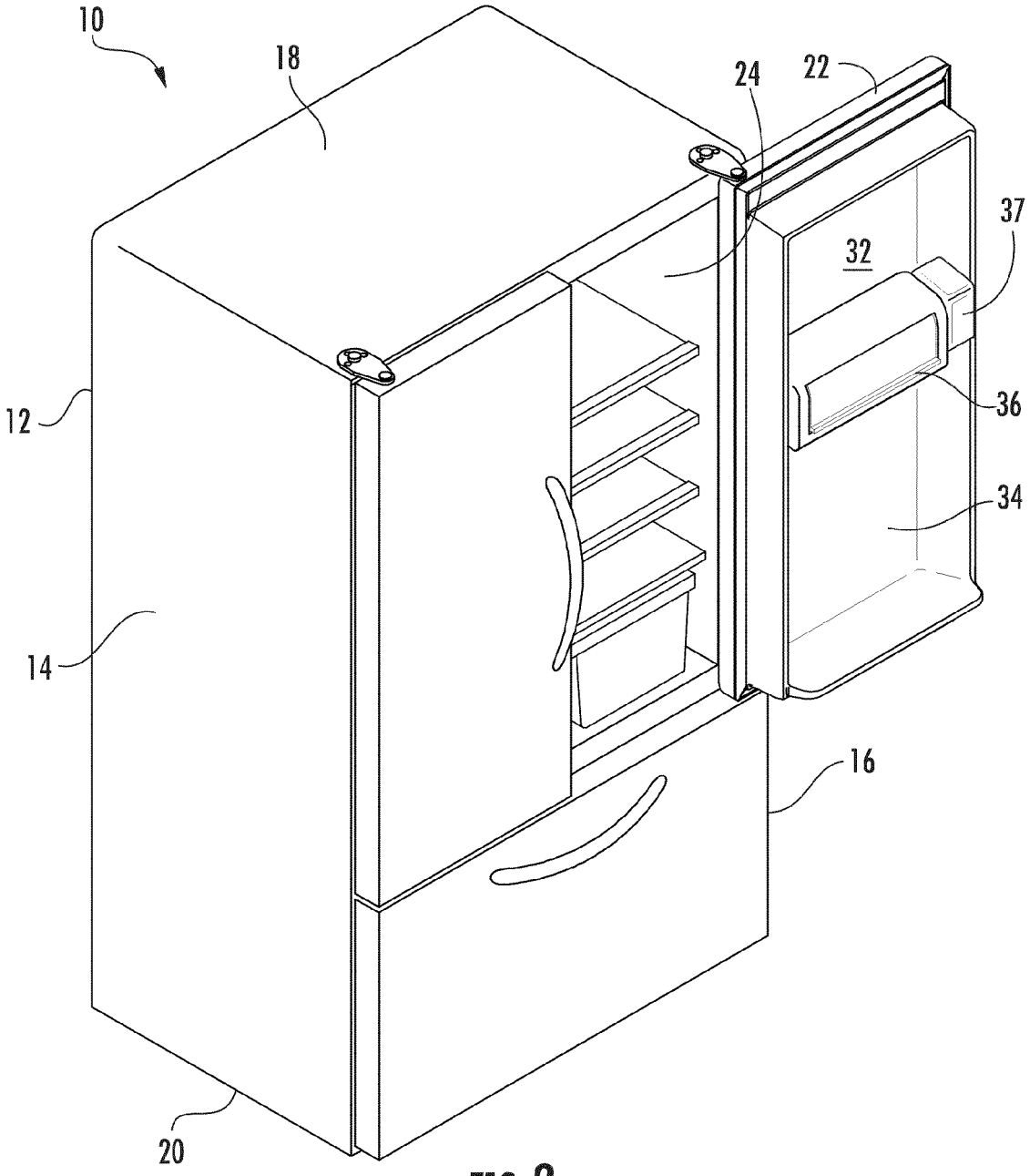
FIG. 2 is an upper left perspective view of the appliance modular system.

The reference number 10 (FIGS. 1-2) generally designates an appliance modular system with a rear wall section 12, a first side wall section 14, a second side wall section 16, a top 18, a bottom 20, and at least one appliance door 22 providing access to the refrigerator section 24 where the rear wall section, the first side wall section, the second side wall section, the top and bottom and the appliance door define an appliance interior. The refrigerator section 24 within the appliance interior may have the same or a smaller volume than the overall interior of the appliance, i.e., the appliance may be solely a refrigerator or be an appliance having both a refrigerator section and another section, such as a freezer section. The door(s) 22 of the appliance 10 have an exterior surface 28 and an interior surface 30 typically having a door liner 32. The liner 32 is typically formed with a cavity or pocket 34 for receiving one or more feature modules with the same or different features. The feature module 36 of the present invention may, for example, produce a modified atmosphere to preserve food such as that disclosed in commonly owned U.S. patent application Ser. Nos. 12/343,682 and 12/343,690, the disclosures of which are hereby incorporated by reference in their entireties. The cavity or pocket 34 and/or the feature module 36 are/is capable of receiving a utility supply module 37 that includes at least one reservoir 39 (FIG. 12) that stores utilities which may be supplied to the feature module 36.

The illustrated appliance 10 is shown with the door hingably attached to the appliance 10. The appliance door 22 covers at least a portion of the refrigerator section 24 that lies within the appliance interior 26, and as shown, the door 22 is in an opened position. The appliance door 22 has an exterior surface 28 and an interior surface 30, with the interior surface 30 exposed in the opened position. The door liner 32 at least partially covers, but more typically covers all or substantially all of the interior surface 30 of the appliance door 22. An interface between the feature modules and the appliance door 22, such as interconnecting tabs and grooves or a magnetic engagement, allows for quick and easy installation docking without the use of tools. Differently sized feature modules 36 may be accommodated through the use of spacer systems that engage the interior of the appliance door 22 and shorten the lateral distance that the feature module 36 must traverse to engage the spacer. The spacer, when used would mimic a smaller mounting distance/door pocket or cavity 34 and similarly have an interface such as a tabular or groove mating, or magnetic engagement.

The modular construction and interchangeability of feature modules 36 minimizes manufacturing costs and allows the feature module 36 to be original equipment or after-market components retro-fit into appliances, after the initial purchase and installation of the appliance 10 in a consumer's home. This interchangeability provides flexibility and improved food preservation and storage for the consumer, improved choice of feature modules 36 with opportunity to upgrade or replace without replacing the whole refrigerator based upon lifestyle or life stage changes, and allows the consumer to take advantage of new technology improvements and new features as new feature modules 36 are designed and developed.

A feature module 36 according to one embodiment of the present invention is removably engaged with the appliance door 22 and sized to fit within the door liner 32 typically within the cavity or pocket 34 of the door liner 32. As discussed above, engagement of the feature module 36 with the door 22 occurs by engaging the feature module 36 with the appliance door 22 in any convenient manner, such as by interlocking tabs, a small support shelf or floor, or other mechanical means or a magnetic arrangement (for example, a magnet on each side of the module for attraction to magnets of opposite polarity on each side of the door liner) may also be used. When appropriate for the feature module 36, engagement of the feature module 36 to the appliance door 22 can automatically couple electrical, gas, and/or fluid lines in the door 22 and in the feature module 36 so as to provide functional features to the feature module 36. The appliance door 22 typically includes a feature module 36 engaging connector 38 (FIG. 3) for providing the electrical power to the feature module 36. The feature module engaging connector 38 may also provide one or more utilities such as fluids and chilled air to the feature module 36. Conceivably, a separate utility connector could be used such that power or other utility is serviced differently from the other utility or utilities.

Figure 3:
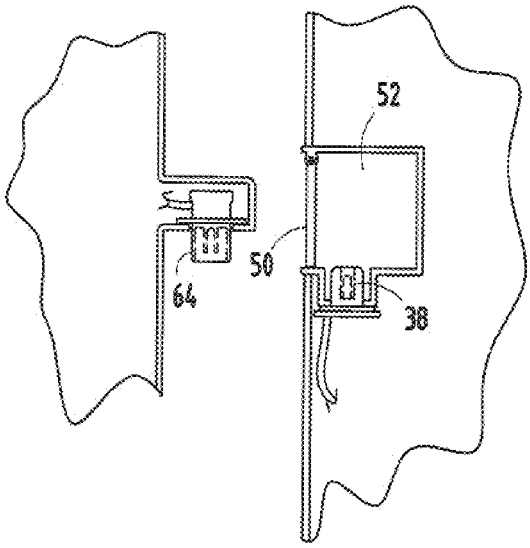
FIG. 3 is an elevational side view of a feature module just prior to engaging a refrigerator door.
Figure 3A:
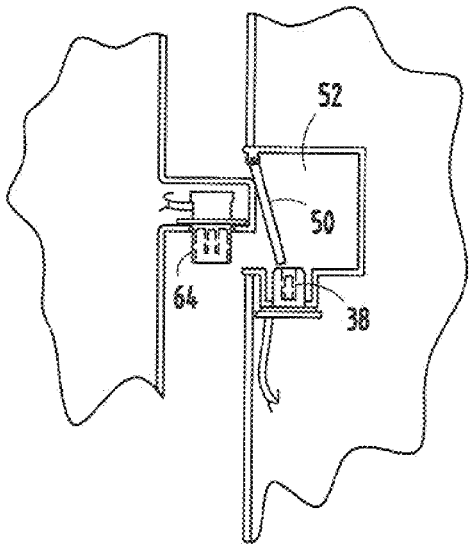
FIG. 3A is an elevational side view of the feature module engaging the refrigerator door.
Figure 3B:
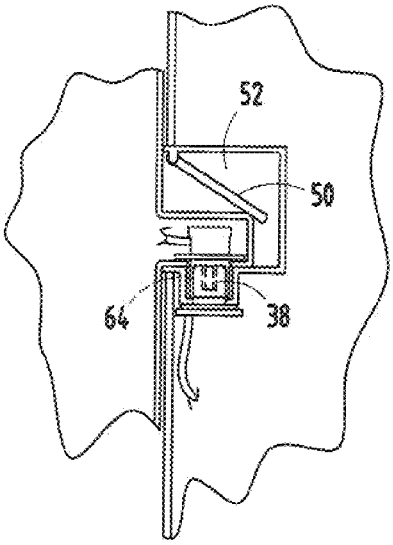
FIG. 3B is an elevational side view of the feature module engaged with the refrigerator door.
Figure 3C:
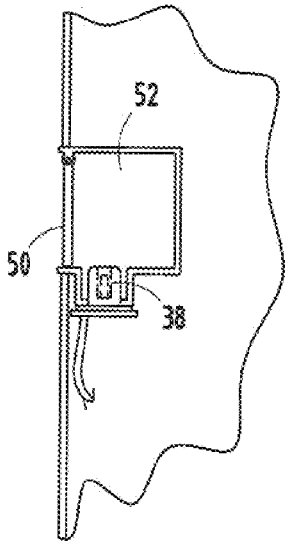
FIG. 3C is an elevational side view of a refrigerator door port area after removal of the feature module.
Figure 4:
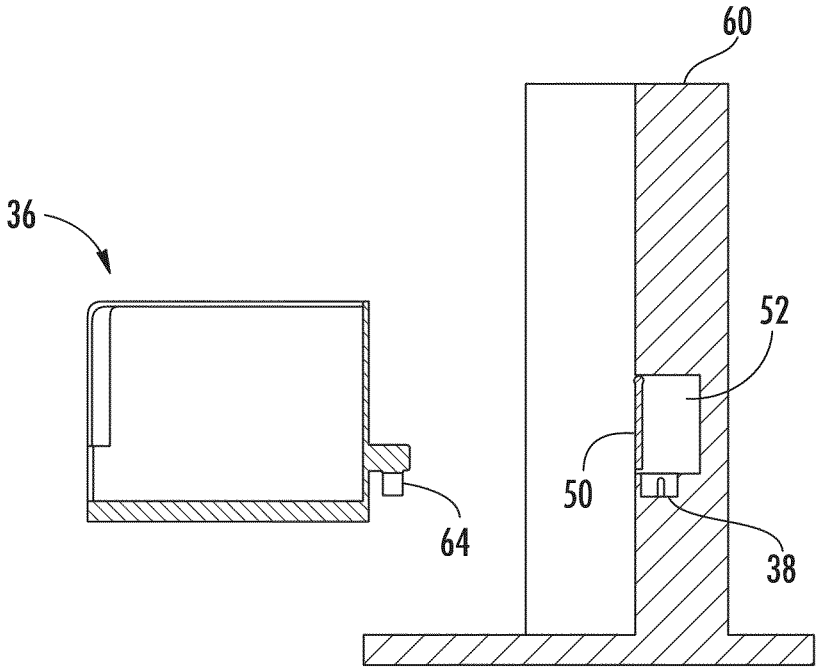
FIG. 4 is an elevational side, cross-sectional view of the feature module prior to engaging a countertop stand illustrating the portability of the feature module.
Figure 5:
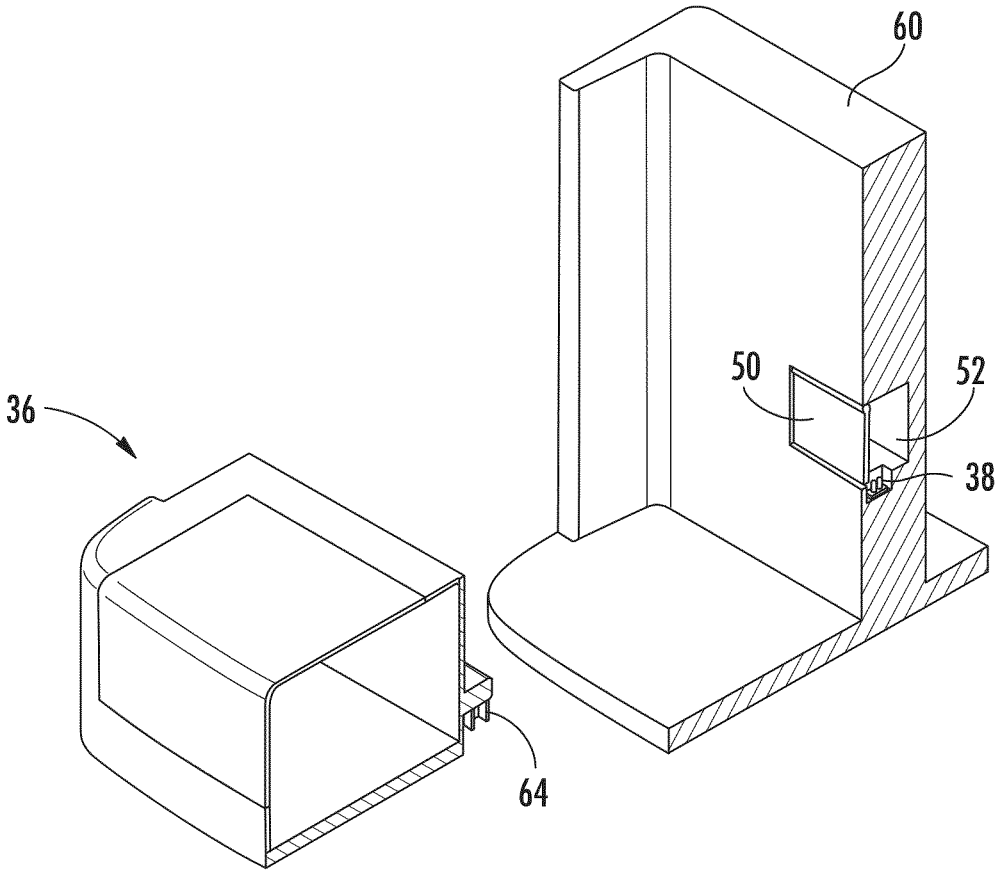
FIG. 5 is an upper right perspective, cross-sectional view of the feature module prior to engaging the countertop stand illustrating the portability of the feature module.
Figure 6:
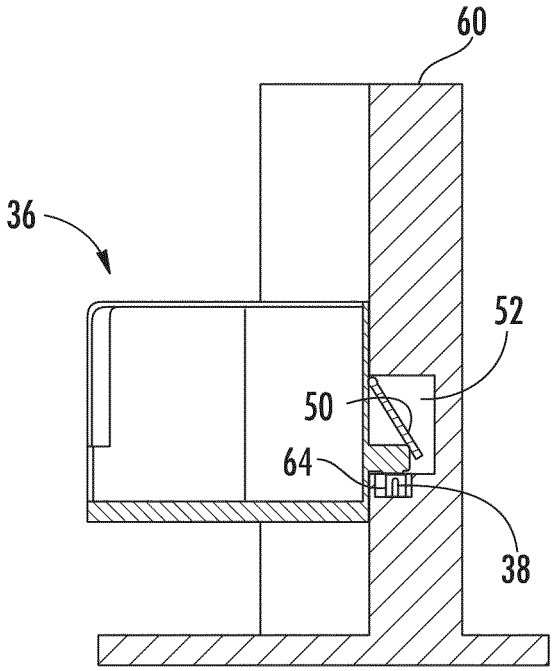
FIG. 6 is an elevational side, cross-sectional view of the feature module engaged to the countertop stand illustrating the portability of the feature module.
Figure 7:
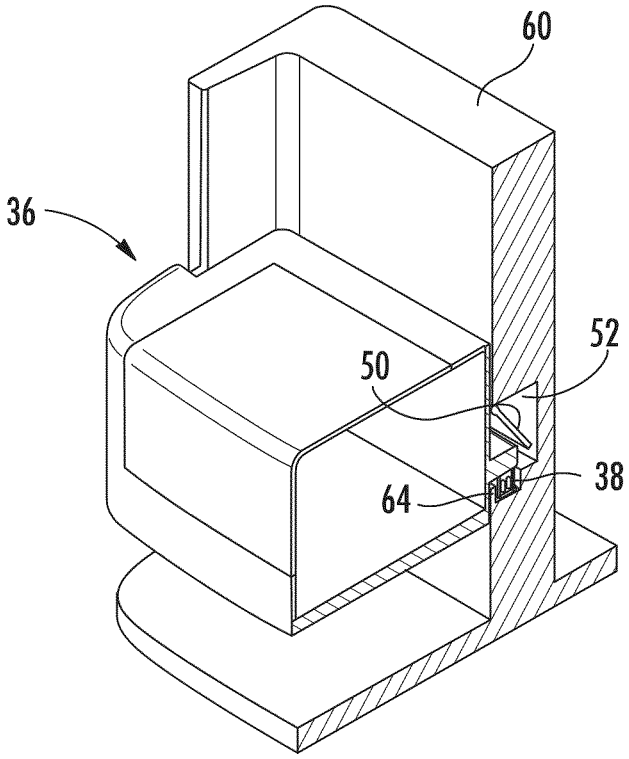
FIG. 7 is an upper right perspective, cross-sectional view of the feature module engaged to the countertop stand illustrating the portability of the feature module.
Figure 8:
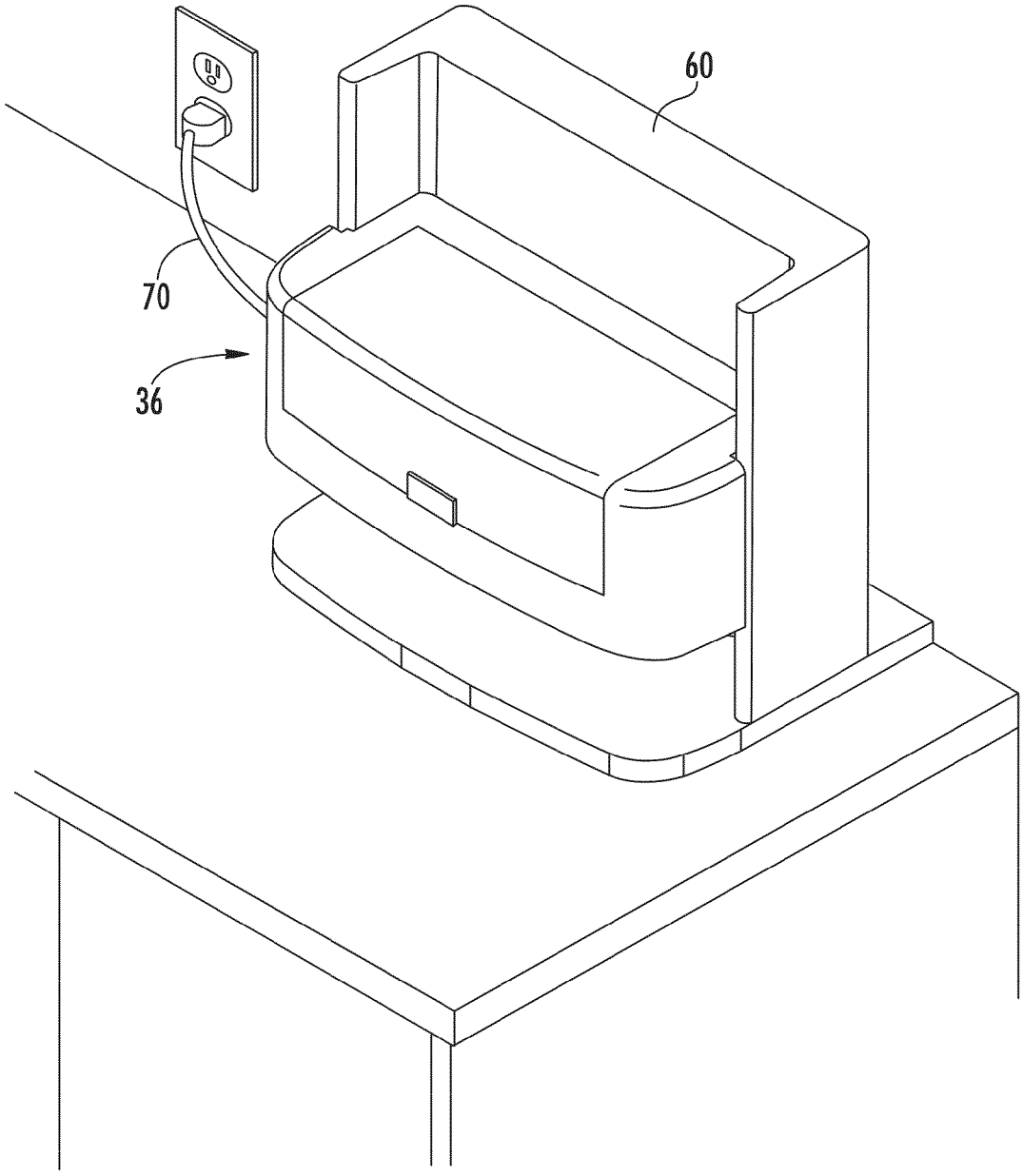
FIG. 8 is an upper right perspective view of the feature module engaged to the countertop stand illustrating a powered connection to a power source.

The door liner 32 may provide the ability to engage a plurality of feature modules 36 to the appliance 10. FIGS. 3-3C generally illustrate the engagement of a feature module 36 to an appliance door 22. Typically, a spring biased connection port cover 50 is hingably engaged with the door liner 32 or appliance door 22 such that when a feature module is not engaged with the appliance door, the connector with the port area 52, typically a female connector in the door liner 32 for engaging the feature module, is protected against debris from the food or other items stored in the appliance 10 that would potentially block or hamper operable connection of the feature module. Alternatively, rather than a hinged door protecting the port area 52, a removable cover may be fastened to the liner 32. The removable cover may be fastened by screws, bolts, clipping equipment, or any other suitable fastener. The removability of the cover allows a user to store the cover while the feature module is engaged to the door 22 and fastening of the cover to the door upon the absence of the feature module. In another embodiment, the cover can be slidable along a track or retract to provide access to the port area 52. Furthermore and alternatively, the door 22 or other mounting surface may employ the "male" connector with the connector protruding therefrom and a "female" type connector employed on the feature module. In this embodiment, a plate over an access cavity on the liner is removed, thereafter a connector support member is engaged to the liner or other appliance surface and the feature module engaging connector is engaged to the connector support. Typically, the connector support is a trough-like structure having an upper perimeter, a floor and side walls around at least a portion of the floor that define the upper perimeter. The feature module engaging connector is typically seated within the area defined by the side walls, most typically on the floor of the connector support member.

While a push switch as discussed above may be used, alternative engagements of the feature module with the appliance door may be used instead of, or in addition to, the push switch. Such engagements are disclosed in commonly owned U.S. patent application Ser. No. 12/539,651, entitled "Park Place Refrigerator Module Utilities Enabled Via Connection," the disclosure of which is hereby incorporated by reference in its entirety. The feature module may be provided with electrical contacts that are engageable with electrical contacts of the appliance when the devices are coupled together. Electrical contacts may be connected through a known signature resistance, which may vary from one feature module to another to provide coded information relating to the type or characteristics of the feature module. The signature resistance may be connected in parallel with the electrical load of the electrical components of the feature module. More particularly, the electrical load is the system resistance effectively provided by components of the feature module, such as a motor and/or other operational circuitry. The signature resistance may be substantially smaller than the resistance of the electrical load so that the combined resistance will be substantially the same as the signature resistance. For example, if the operational circuit has an electrical load offering a resistance of 200 ohms, a signature resistance of 7 ohms may be provided in parallel, so that the signature resistance and the electrical load together presents a resistance of a little less than 7 ohms across the electrical contacts.

The appliance interface may include a feature module recognition device having a comparator circuit or other decision making circuit connectable to the resistances to measure and evaluate the combined resistance and also thereby determine the type of feature module 36 being connected at the time that a given feature module is connected. The module recognition device may then selectively provide power to the supply line or otherwise selectively permit the flow of utility from the appliance to the feature module 36, or from the feature module 36 to the appliance 10 that is appropriate for the identified feature module. The signature resistance will have minimal effect on the operation of the electrical components of the feature module 36.

Alternatively, the module recognition device may be a reed switch provided in the appliance door 22 for activation by a magnet imbedded in the side wall of the feature module 36 so as to complete an electrical circuit when the feature module 36 docks into the door pocket. Contact pads on the appliance door 22 and on the feature module 36 that complete the electrical circuit when the feature module 36 is mounted in the door liner 32 may also be employed. Completion of such an electrical circuit would selectively permit the supply or transfer of utility from the appliance 10 to the feature module 36, or vice versa, similar to the utility transfer described above, but only after the module is fully engaged thus ensuring the utility coupling is secure against leakage.

A DIP switch may be employed as the module recognition device. The DIP, dual in-line package, switch will typically include a plurality of switches, each of which may be positioned in one or more, but typically two settings, as well as a plurality of socket pins. This type of switch is designed to be used on a printed circuit board along with other electronic components. The appliance typically includes a plurality of pin sockets to receive the dip switch package. DIP switches are an alternative to jumper blocks. A DIP switch alternative provides the ability to set the switches of the package to specific setting combinations which will customize the utilities supplied to the engaged feature module, based upon the specific requirements of that module.

The signature resistance with comparator circuit, as well as the reed switch and dip switch examples, when employed, allow the appliance; or utility supply source, such as a wall mounted feature module engaging station; or countertop stand to identify specific feature module connections, thereby ensuring that the appropriate utility is supplied to a feature module based upon the utilities needed by the feature module. The utility provided may be, but is not limited to, electrical power, mechanical power, as well as gases, fluids such as conditioned (heated, cooled, or filtered water), and solids. The required utility will vary based upon the application and functional properties of the connected feature module. The structural components that identify which feature module is connected to the appliance 10 facilitates the provision of such utility.

Figure 9:
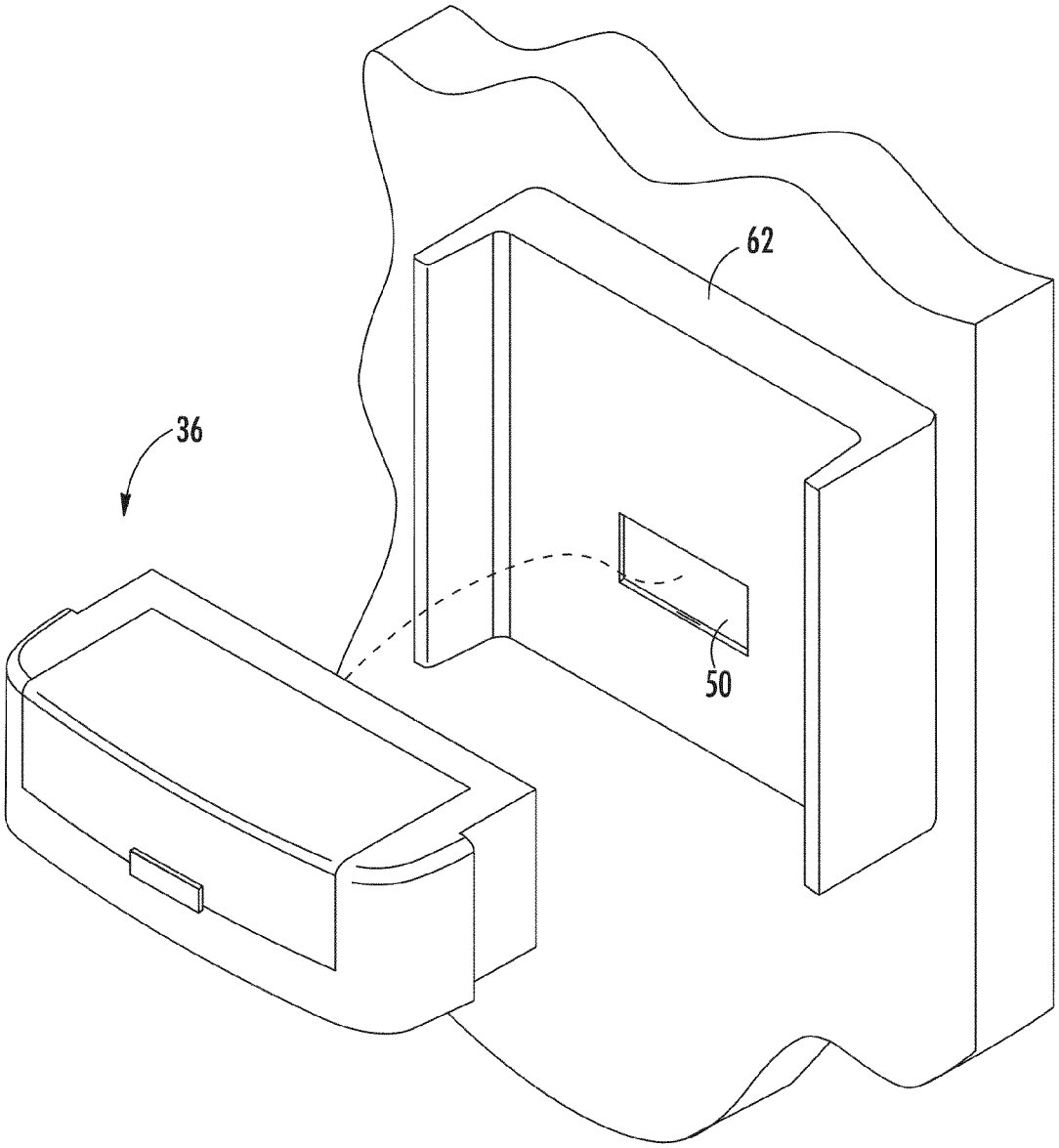
FIG. 9 is an upper right perspective view of the feature module prior to engaging a mounted wall bracket illustrating the portability of the feature module.

In addition to being engaged with the exterior surface or the interior surface of the door of an appliance, the feature module of the present invention may optionally be engaged with a countertop stand 60 (FIGS. 4-8) and/or a wall bracket 62 (FIG. 9). The countertop stand 60 and wall bracket 62 would typically also include a feature module engaging connector 38 within a port area 52 protected by a spring-biased port cover 50 alternatively the connector support member as discussed above may be utilized. The feature module 36 typically draws electrical power and optionally other utilities. Conceivably, the feature module could also be engaged to any other surface of the appliance, such as a side, top, or even back portion of the appliance. Engagement to these surfaces would be accomplished in the manner previously discussed and utility may be drawn in a similar fashion. Of course, if the feature module would be engaged to the top of an appliance the connector of the feature module would typically be spaced on the bottom of the feature module to facilitate easy attachment of the feature module to the appliance. Similarly, if the feature module were engaged to a side wall of the appliance, the connector on the appliance would be on the side wall and the connector on the feature module could be on a side or back wall of the feature module. Conceivably, multiple connectors on a given module may be used.

When a countertop stand 60 is utilized, the stand typically includes a base and an upright section that substantially mimics a pocket or cavity of a refrigerator or other appliance door liner (FIGS. 4-8). The feature module 36 typically engages the sides of the countertop stand 60 for retaining the feature module in place via interlocking tabular members, and/or a pin type arrangement or other mechanical means or magnetically as described above. Typically, as when the feature module engages the interior door of the appliance, the countertop stand 60 or wall bracket 62 (FIG. 9) includes a spring biased hinged cover 50 that inwardly pivots when the feature module's connection plug (typically male-type) is inserted therein. The cover 50, as discussed before, prevents debris and other materials from contacting the feature module engaging connector of the countertop stand 60 and/or wall bracket 62. The feature module 36 typically contains a generally L-shaped connection plug 64 (male-type) that is inserted into the cavity containing the feature module engaging connector 38 thereby moving the cover 50 inward about the hinge. The feature module 36 is engaged with the feature module engaging connector 38 when the feature module is placed into position and dropped into engagement with the countertop stand 60, wall bracket 62, or appliance door 22 (FIGS. 3-3C). The countertop stand 60 itself may draw electrical power from a separate outlet or directly from the appliance via an umbilical utility cord 70 type attachment. The utility cord 70 from the appliance could also conceivably supply cold air or liquid (such as conditioned water) or other utilities to the feature module.

Figure 10:
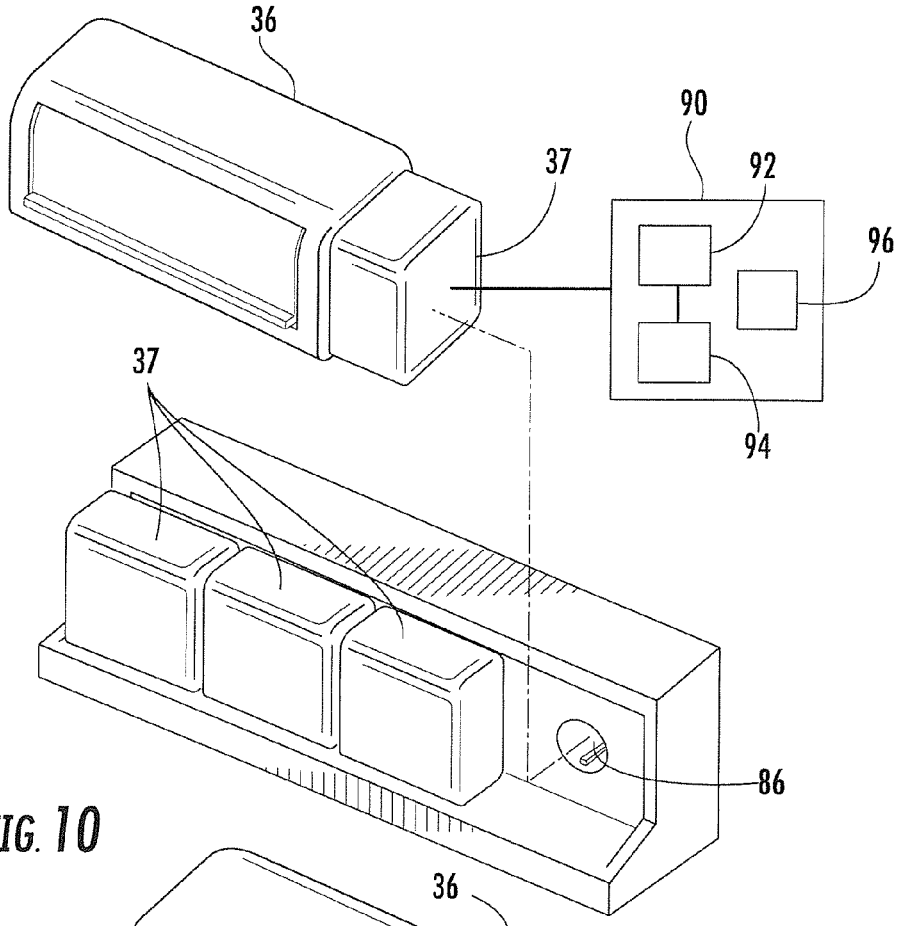
FIG. 10 is an upper right perspective view of the feature module engaged with a utility supply module and a charging station for at least one utility supply module.
Figure 11:
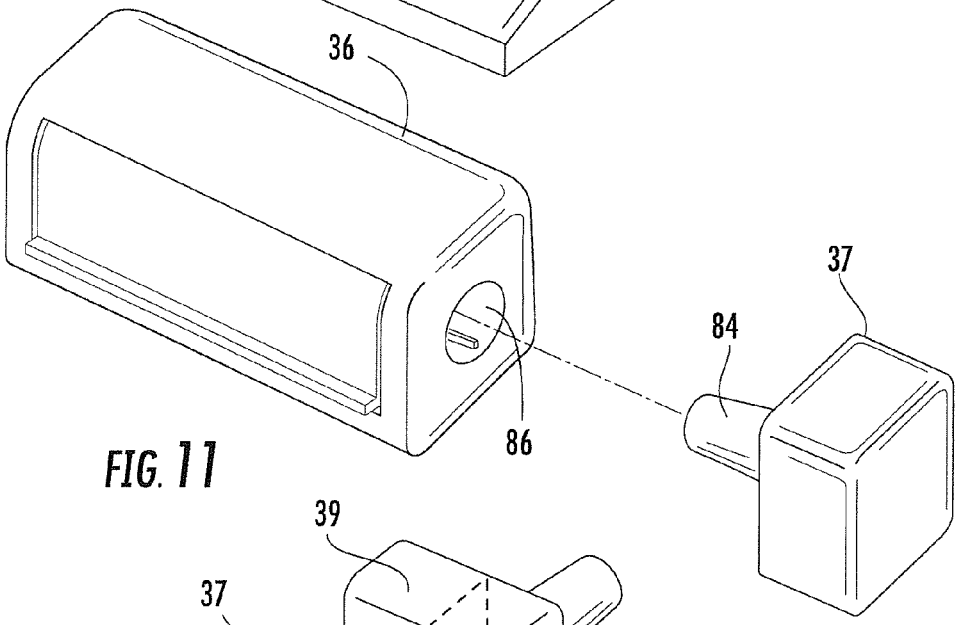
FIG. 11 is an upper right perspective view of the utility supply module prior to engaging the feature module.
Figure 12:
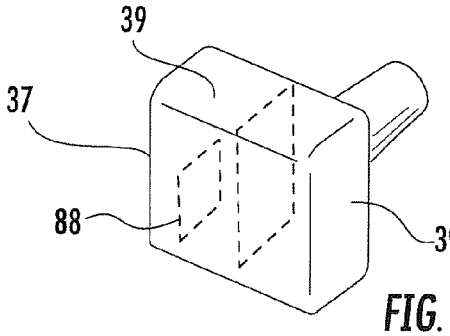
FIG. 12 is an upper right perspective view of the utility supply module illustrating a plurality of reservoirs within the utility supply module.

Whether engaged with an appliance, countertop stand, or a wall, the utility supplied to the feature module is typically limited to the capability of the supply line which the feature module 36 is connected to. For example, a water line that runs from a house supply line through the appliance may be limited to providing one liter of water per minute, based on the volumetric flow rate of the house supply line. However, a beverage machine of a feature module 36 may require one liter of water at high flow, thereby rendering the house supply undesirable. Therefore, a supplemental utility supply is provided by engaging a utility supply module 37 to the feature module 36 (FIGS. 10-12). The utility supply module 37 includes a housing and at least one refillable reservoir 39 that is capable of storing a plurality of utilities. The utilities stored within the reservoir(s) 39 may include, for example, power or materials. Various reservoirs 39 may function as a variety of utility sources, including, but not limited to, a battery or fuel cell, a water tank (typically storing conditioned water), a gas cylinder containing gases commonly used in consumable storage environments, a powder or liquid chemical reactant, a desiccant, a food preservative or other gas absorbent, a flavorant, a heat sink, or a pressure vessel providing vacuum or pneumatic pressure.

Figure 13:
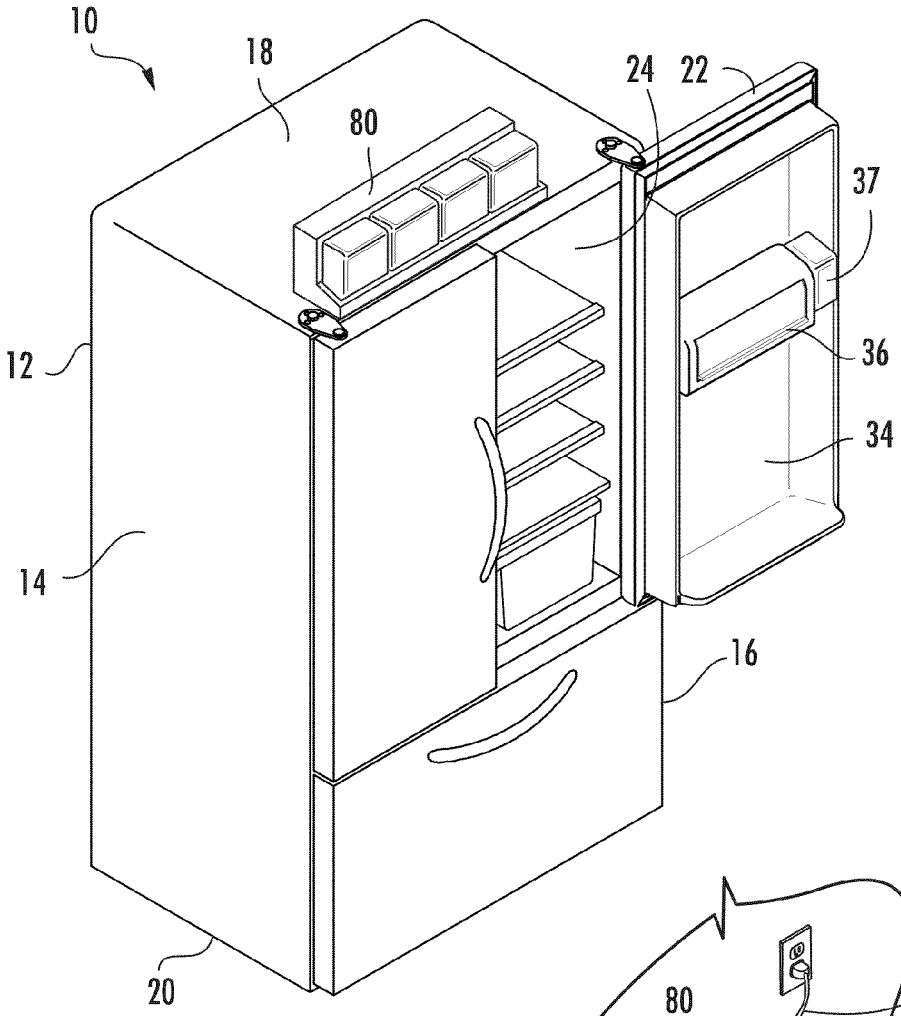
FIG. 13 is an upper right perspective view of the appliance modular system having a top cap structure charging station for charging at least one utility supply module.
Figure 14:
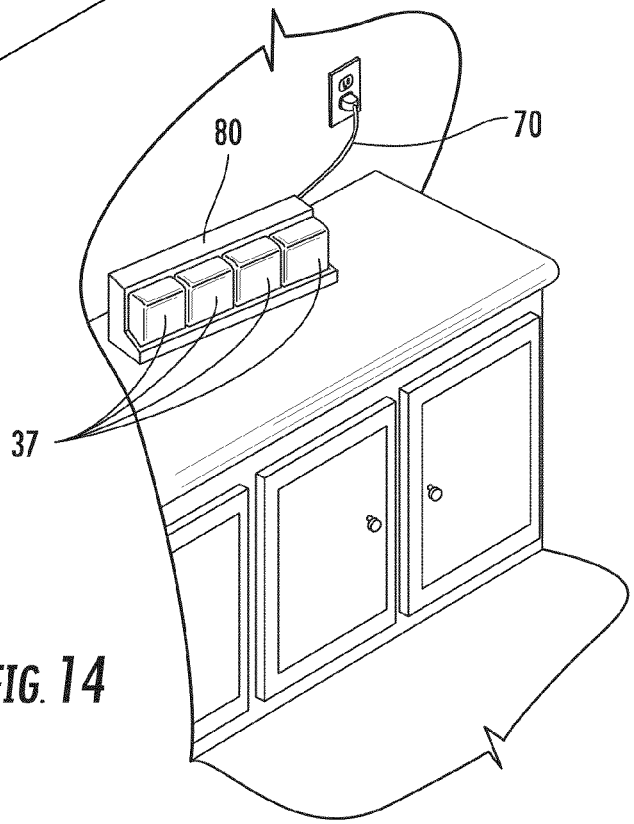
FIG. 14 is an upper left perspective view of a countertop charging station for charging at least one utility supply module.

The power or materials stored in each reservoir 39 may be done in a number of ways. Each reservoir 39 may be filled and refilled manually by a user, for example by simply pouring water into a reservoir 39 functioning as a water tank. Alternatively, a reservoir 39 may be filled on a charging station 80 (FIGS. 13-14). Such a charging station 80 may be located remotely, such as on a countertop or wall mount (FIG. 14). The charging station 80 may also be conveniently located on an exterior surface of the appliance 10, such as a top cap structure on the top of the appliance 10 (FIG. 13). Another filling alternative involves a direct supply from the appliance 10, in the case where the utility supply module 37 is engaged directly to the appliance 10 and the appliance utility supply line (e.g., a residential water supply). This alternative provides the opportunity for the utility supply module 37 to replenish the reservoir(s) 39 while the feature module 36 is not operational, a time period the feature module does not require a utility. The direct supply alternative allows for the otherwise insufficient appliance utility supply line to provide the utility supply module reservoir(s) 39 with a constant utility supplement prepared for the feature module 36. Irrespective of the filling option, upon prompting from the feature module 36, the utility supply module 37 will have a stored utility supply available to be distributed through a utilities bus 88 to the feature module 36.

As is the case with the engagement of the feature module 36 to the appliance 10, the utility supply module 37 may be removably engageable with the appliance door 22 and sized to fit within the door liner 32 typically within the cavity or pocket 34 of the door liner 32. The door 22 would typically also include a connector, either a female connector or a male connector typically of the type discussed previously for the utility supply module 37. Similarly, connection in this manner may be made to a charging station 80 in the form of a countertop stand, a wall mounted bracket, or a top cap structure. Additionally, alternative connections and device recognition structures may be employed to identify which utility supply module 37 is engaged, as is the case with the connections described above for the feature module connections (i.e., signature resistance, comparator circuit, reed switch, dip switch, etc.). Such identification facilitates communication between the utility supply module 37 and the engaged structure, whether it be an appliance 10 or a charging station 80, thereby allowing the appropriate utility to be supplied from the source to the utility supply module 37. In particular, the identification facilitates communication with the utility supply module 37, including computer control system 90, processor 92, memory subsystem 94, and communication and detection system 96. The engagement between the utility supply module 37 and the appliance 10 or charging station 80 results in the ability to transfer substances to the utility supply module 37, via a conduit or pathway that is established between the utility supply module 37 and the appliance 10 or charging station 80.

The feature module 36 is configured to engage the utility supply module 37 via a standardized utility connection or coupling 84, 86. The connection or coupling 84, 86 may also be similar to that described above for the engagement of the feature module 36 to the appliance 10 (i.e., signature resistance, comparator circuit, reed switch, dip switch), countertop stand 60, or wall mounted bracket 62, particularly the feature module recognition device, as well as the connection or coupling between the utility supply module 37 and the appliance 10 or charging station 80. Based upon the feature module recognition, the utility supply module 37 is capable of transferring utility to the feature module 36 in a similar fashion as that described above for transfer between the appliance 10 or charging station 80 and the utility supply module 37. Utilization of the modularity of both the feature module 36 and the utility supply module 37 allows a user to switch feature modules 36 and to position a feature module 36 at various locations within the appliance 10, thereby avoiding the need to have a utility supply hardwired directly into the feature module 36. The utility supply module 37 allow for quicker and/or longer supply of the utility to the feature module than can typically be obtained from the appliance alone or without the use of the utility supply module(s).

As noted above, the reservoirs 39 may function as a variety of utility sources and examples of particular applications will be described below, however, this functionality of the utility supply module reservoirs 39 is not intended to be limited to the following descriptions. First, a battery or fuel cell may obtain a "trickle" charge during non-use of the feature module 36, subsequently delivering a high wattage when prompted. A water tank may be supplied by an external line or a gravity feed, after which a complete deposit may be made to the engaged feature module 36. A gas cylinder containing gases that may be employed to manipulate a food, beverage, or other consumable storage environment, may incur a slow buildup of such gases in order to transfer the gases to the feature module 36. The reservoir 39 may serve as a heat sink, such as an insulated vessel that employs glycol or chilled water to provide a fast chill or quick thaw when required by the feature module 36. A pressure vessel may serve as a reserve chamber, or a surge tank on a well pump, in order to provide a vacuum or pneumatic pressure as needed by the feature module 36. The reservoir can house an ethylene absorbent material that will extend the freshness or life of stored food. Additionally, various food stuffs or flavorants may be stored in a reservoir 39 in order to restock the feature module 36. Finally, the reservoir 39 may serve as storage for a powder or liquid chemical reactant, as well as a desiccant.

It is to be understood that variations and modifications can be made on the aforementioned structure without departing from the concepts of the present invention, and further it is to be understood that such concepts are intended to be covered by the following claims unless these claims by their language expressly state otherwise.

The invention claimed is:

1. An appliance modular system comprising:

an appliance wherein the appliance comprises:

a cabinet having an exterior surface and an interior surface and defined by a rear wall section, a first side wall section, a second side wall section, a top, a bottom, and at least one appliance door, that together define an interior volume of the appliance; and a refrigerator section within the appliance interior volume and having the same or a smaller volume than the interior volume of the appliance, wherein the appliance door has an exterior surface and an interior surface having a door liner;

at least one feature module configured to be removably engaged and disengaged with the appliance without the use of tools and wherein the feature module comprises a utility engagement system that provides at least one utility engagement system, a utility sourced from the appliance to the feature module and includes a protrusion and a recess that releasably and matingly engages the protrusion and either the recess or the protrusion of the utility engagement system is on a wall of the module that engages a mounting location of the feature module exterior surface or the interior surface of the cabinet on the appliance and is configured to allow one or more utilities to be delivered to the feature module for use by the feature module from the appliance through the exterior surface or interior surface of the cabinet using the utility engagement system when the protrusion and the recess are matingly engaged with one another and the mounting location of the feature module on the appliance further comprises the protrusion or recess not located on the wall of the feature module; and utility supply module comprising:

a common interface configured to removably engage at least one feature module without the use of tools, wherein the interface comprises a module recognition device for identifying the feature module; and at least one refillable reservoir configured to store a plurality of supplemental utilities and provide supplemental utilities via the common interface to the feature module in excess of utilities the feature module receives from the utility engagement system and wherein at least one of the plurality of utilities is supplied to the feature module when the utility supply module is engaged to the feature module.

2. The appliance modular system of claim 1, wherein the utility supply module comprises a plurality of refillable reservoirs within the utility supply module where each reservoir is configured to separately store a supplemental utility and each reservoir is configured to provide the supplemental utility to the feature module that is the same utility the feature module receives from the appliance via the utility engagement system and wherein the appliance further comprises a top cap structure located on an exterior surface of the appliance, the top cap structure including at least one charging station configured to engage the utility supply module and supply at least one of the refillable reservoirs with at least one of the supplemental utility via the charging station when the utility supply module is operably engaged with the charging station.

3. The appliance modular system of claim 2, wherein the engaged feature module is removably engaged with the interior surface or exterior surface of the appliance door and configured to be repeatedly, operably engaged and disengaged from the interior surface or exterior surface of the appliance door and wherein the feature module further comprises an access door that allows user access to an interior volume of the feature module defined and enclosed by a feature module housing and the access door and wherein the common interface is configured to engage a plurality of different feature modules that each provide different functionality and wherein the top cap structure is positioned on the exterior surface of the top of the appliance.

4. The appliance modular system of claim 1, wherein the at least one of the plurality of supplemental and utility engagement system utilities are selected from the group consisting of a battery, fuel cell, water, gas, chemical reactant, desiccant, gas absorbent, foodstuff, flavorant, heat sink, pressurized air, and combinations thereof and wherein the exterior surface and the interior surface of the appliance door define a space therebetween and wherein the recess or protrusion of the utility engagement system on the mounting location engages an appliance utility supply line through the space between the exterior surface and the interior surface of the appliance door.

5. The appliance modular system of claim 4, wherein the at least one reservoir is manually refilled with at least one of the plurality of supplemental utilities and at least one reservoir provides at least one of the utilities stored in the reservoir at a faster rate than the rate the same utility can be supplied from the appliance and wherein the recess or protrusion of the utility engagement system is on a rear wall of the module that engages the mounting location of the feature module.

6. The appliance modular system of claim 4, wherein the at least one reservoir is refilled automatically from the appliance and the utility supply module comprises a utilities bus that is configured to refill the reservoir with at least one of the plurality of utilities and the at least one reservoir provides at least one of the utilities stored in the reservoir at a faster rate to the feature module than can be supplied to the feature module from the appliance by a supply line of the utility operably coupled to either the protrusion or the recess of the utility engagement system located at the mounting location on the appliance.

7. The appliance modular system of claim 4, wherein the module recognition device includes a computer control system operatively connected to the utility supply module, wherein the computer control system comprises a processor and a memory subsystem coupled to the processor where the memory subsystem stores code that, when executed based upon input received from the engaged feature module, at least one of the plurality of supplemental utilities is identified and selected to be supplied to the engaged feature module from the utility supply module that is operatively connected to the feature module.

8. The appliance modular system of claim 4, wherein the module recognition device comprises a communication and detection system, wherein the communication and detection system is selected from the group consisting of a reed switch, dip switch, and a comparator circuit, and wherein at least one of the plurality of utilities is automatically identified and selected to be supplied to the engaged feature module from the utility supply module based upon the communication and detection system and wherein the common interface is configured to engage a plurality of different feature modules that each provide different functionality.

9. The appliance modular system of claim 1, wherein the module recognition device comprises the communication and detection system, wherein the communication and detection system is selected from the group consisting of a reed switch, dip switch, and a comparator circuit.

10. A modular, utility supply unit comprising:

a utility supply module housing configured to be removably engaged and disengaged with a surface of an appliance without the use of tools;

at least one refillable reservoir configured to receive and store a plurality of supplemental utilities wherein the supplemental utilities are supplied to and delivered into the at least one refillable reservoir by the appliance when the utility supply unit is operably engaged to the appliance;

an interface configured to engage a plurality of different feature modules that provide different features to a user and wherein the interface is configured to deliver at least one utility sourced from the appliance to the plurality of different feature modules through the interface, wherein the interface includes a recognition device that prompts the utility supply unit to provide the engaged feature module with at least one of the stored supplemental utilities within the utility supply module from at least one of the refillable reservoirs; and wherein the recognition device comprises a communication and detection system, wherein the communication and detection system is selected from the group consisting of a reed switch, dip switch, and a comparator circuit.

11. The modular, utility supply unit of claim 10, wherein the unit is configured to engage both the appliance and at least one of a countertop stand and a wall mounted bracket and the plurality of utilities chosen from the group consisting of electricity, water or both electricity and water and wherein the at least one refillable reservoirs are configured to be refilled with a plurality of supplemental utilities supplied received from the appliance into the at least one refillable reservoirs.

12. The modular, utility supply unit of claim 10, wherein the appliance is a refrigerator and at least one of the plurality of supplemental utilities is selected from the group consisting of: a battery, fuel cell, water, gas, chemical reactant, desiccant, gas absorbent, foodstuff, flavorant, heat sink, pressurized air, and combinations thereof and wherein the utility supply module housing is configured to be removably engaged and disengaged with a surface of the plurality of different feature modules without the use of tools.

13. The modular, utility supply unit of claim 12, wherein the at least one reservoir is manually refilled with at least one of the plurality of supplemental utilities and the modular, utility supply unit comprises a plurality of reservoirs capable of storing a plurality of supplemental utilities.

14. The modular, utility supply unit of claim 12, wherein the at least one reservoir is refilled automatically from the appliance and the utility supply module comprises a utilities bus that is connectable to a source and is configured to refill the reservoir with at least one of the plurality of supplemental utilities.

15. The modular, utility supply unit of claim 10, wherein the recognition device includes a computer control system operatively connected to the utility supply module, wherein the computer control system comprises a processor and a memory subsystem coupled to the processor where the memory subsystem stores code that, when executed based upon input received from the engaged feature module, selects and automatically identifies at least one appropriate utility selected from the plurality of supplemental utilities stored in the utility supply module to be provided from the modular, utility supply unit to the feature module and wherein the plurality of different feature modules provide different features.

16. A method for supplying utility to various feature modules comprising:

providing:

an appliance cabinet having a rear wall section, a first side wall section, a second side wall section, a top, a bottom, at least one appliance door, and having an interior;

a refrigerator section within the appliance interior and having the same or a smaller volume than the interior of the appliance, wherein the appliance door has an exterior surface and an interior surface defining a space therebetween and wherein the appliance door closes to create an insulated volume;

a utility supply module configured to be removably engaged and disengaged with the appliance without the use of tools, the utility supply module having a common interface that provides engageability to a plurality of feature modules, the interface having a module recognition device for identifying the class of feature module the utility supply module is engaged with, the utility supply module having at least one refillable reservoir capable of storing a plurality of utilities, wherein at least one of the plurality of utilities is selectively supplied to the engaged feature module from an engaged utility supply module via a utility engagement system when the feature module is engaged with the appliance and wherein the utility engagement system includes a protrusion and a recess that releasably and matingly engages the protrusion and either the recess or protrusion of the utility engagement system is on an exterior wall of module that engages a mounting location of the feature module on a surface of the appliance cabinet;

engaging the utility supply module with the appliance;

replenishing the at least one refillable reservoir of the utility supply module with a utility sourced and received from the appliance, wherein the utility supply module has access to a plurality of utilities from the appliance;

engaging the feature module with the utility supply module, wherein the feature module engaging step includes operably connecting the feature module to the utility supply module through the common interface, wherein the module recognition device is capable of recognizing which of the plurality of stored utilities is appropriate to supply the engaged feature module based upon input from the module recognition device; and supplying the engaged feature module with at least one of the stored utilities at a second rate that is the same rate or a faster rate than the first rate.

17. The method for supplying utility to various feature modules of claim 16, wherein the step of engaging the feature module to the utility supply module takes place before the step of engaging the utility supply module to the appliance and the utility supply module has a plurality of reservoirs within the supply module each capable of storing a plurality of utilities and wherein the feature module functions independently when operably engaged with a countertop stand, a wall bracket, or the appliance door and without the utility supply module engaged to the feature module.

18. The method for supplying utility to various feature modules of claim 16, further comprising engaging the feature module to the appliance and the utility supply module has a plurality of reservoirs each capable of storing a plurality of utilities and wherein the utility sourced and received from the appliance includes a residential utility received by the appliance from a residential utility supply line between the appliance and a residential utility supply source.

19. The method for supplying utility to various feature modules of claim 16, wherein the at least one of the stored utilities supplied to the engaged feature module is chosen from the group consisting of a battery, fuel cell, water, gas, chemical reactant, desiccant, gas absorbent, foodstuff, flavorant, heat sink, pressurized air, and combinations thereof.

20. The method for supplying utility to various feature modules of claim 16, wherein the step of replenishing each refillable reservoir is done automatically via a utility conduit within the appliance configured to deliver a utility to the utility supply module.

* * * * *